US007104898B1

(12) United States Patent
Caserta

(10) Patent No.: US 7,104,898 B1
(45) Date of Patent: Sep. 12, 2006

(54) GOLF PUTTER TRAINING DEVICE AND METHOD

(76) Inventor: Richard Caserta, 11 N. 2nd St., Apt. 503, Philadelphia, PA (US) 19106

( * ) Notice: Subject to any disclaimer, the term of this patent is extended or adjusted under 35 U.S.C. 154(b) by 122 days.

(21) Appl. No.: 10/828,618

(22) Filed: Apr. 22, 2004

(51) Int. Cl.
*A63B 69/36* (2006.01)

(52) U.S. Cl. ..... 473/236; 473/238; 473/251

(58) Field of Classification Search ..... 473/231–255, 473/257, 258, 260
See application file for complete search history.

(56) References Cited

U.S. PATENT DOCUMENTS

| | | | | | |
|---|---|---|---|---|---|
| 3,021,141 | A * | 2/1962 | Polsky et al. | ..... | 473/236 |
| 3,194,564 | A * | 7/1965 | Swan | ..... | 473/236 |
| 3,384,376 | A * | 5/1968 | Greenlee | ..... | 473/236 |
| 3,667,761 | A | 6/1972 | Palotsee | | |
| 4,291,883 | A * | 9/1981 | Smart et al. | ..... | 473/244 |
| 4,902,014 | A * | 2/1990 | Bontomase et al. | ..... | 473/241 |
| 4,949,971 | A * | 8/1990 | Thornton | ..... | 473/238 |
| 4,953,867 | A * | 9/1990 | Rigsby | ..... | 473/238 |
| 5,213,332 | A * | 5/1993 | Fahy et al. | ..... | 473/243 |
| 5,240,253 | A * | 8/1993 | Cooper | ..... | 473/236 |
| 5,351,961 | A * | 10/1994 | Eulau | ..... | 473/252 |
| 5,447,313 | A | 9/1995 | Finley | | |
| 5,551,695 | A | 9/1996 | Wolk | | |
| 5,709,611 | A * | 1/1998 | Intag | ..... | 473/236 |
| 5,839,974 | A * | 11/1998 | McAllister | ..... | 473/337 |
| 6,117,019 | A * | 9/2000 | Taylor | ..... | 473/46 |
| 6,296,574 | B1 * | 10/2001 | Kaldis | ..... | 473/236 |
| 6,821,212 | B1 * | 11/2004 | Fowler et al. | ..... | 473/236 |
| 2004/0147332 | A1 * | 7/2004 | Engdahl | ..... | 473/236 |

* cited by examiner

*Primary Examiner*—Sebastiano Passaniti
(74) *Attorney, Agent, or Firm*—LaMorte & Associates

(57) ABSTRACT

A putter assembly and the method of converting a putter assembly between a practice configuration and a regulation play configuration. The putter assembly has a shaft. A putter head is attached to the shaft. The putter head has a striking surface for striking a golf ball. A connection receptacle is disposed on the striking surface of the putter head. A training rod is provided that has a predetermined weight. A plug is also provided that has a weight generally equal to that of the rod. Either the rod or the plug can be attached to the connection receptacle in the putter head. When the rod is attached, the putter is configured for use in training, wherein the rod provides a reference guide during putting. When the rod is removed and the plug is set in place, the putter is ready for regulation play.

17 Claims, 4 Drawing Sheets

GOLF PUTTER TRAINING DEVICE AND METHOD

BACKGROUND OF THE INVENTION

1. Field of the Invention

In general, the present invention relates to the structure of putters that are used in playing the game of golf. More particularly, the present invention is directed toward golf putters with secondary visual and/or tactile aids that can be used in developing a proper putting swing.

2. Description of Related Art

In the game of golf, the object of the game is to get a golf ball into a distant golf hole with as few strikes with a golf club as possible. In golf, the hole is positioned on a green of finely manicured grass. When a golf ball lands on the green, it is most commonly struck toward the hole with a putter. A putter is a golf club that has a generally flat striking surface. Thus, when a golf ball is struck with the putter, the golf ball tends to roll forward on the green rather than fly up into the air.

The prior art is replete with many different designs for putters and putter heads. In this collection of designs, there exist many golf putters that have features that are intended to help a golfer practice proper putting techniques.

When a golfer putts, the golfer wants to strike the golf ball flush in the center of the putter, without having the putter experience any lateral movement relative the ball. That is, the head of the putter should only be traveling in the exact direction the golfer wants the golf ball to travel when the putter strikes the golf ball. In order to consistently putt in this manner, a golfer must practice his putting and his golf swing with the putter.

In the prior art, golf putters have been created that contain guide rods. The guide rods extend from the golf putter and provide a visual and/or tactile reference guide that can be used to practice putting. For example, in U.S. Pat. No. 5,447,313, to Finley, entitled Golf Putter With Foldable Aiming Device, a putter is shown having a rod that extends behind the face of the putter at a perpendicular. The rod provides a visual alignment tool to a golfer practicing putting. By aligning the rod with the golf ball and keeping the rod in alignment with the golf ball throughout the putter's swing, a person can train himself/herself to properly swing the putter.

In U.S. Pat. No. 3,667,761, to Palotsee, entitled Golf Putter With Aligning Device, another putter is shown that uses a rod as a visual aid. In this patent, the rod extends out in front of the putter's face and passes over the top of a golf ball as the putter strikes the golf ball. Again, the rod provides a visual alignment tool to a person practicing putting. By aligning the rod with the golf ball and keeping the rod in alignment with the golf ball throughout the putter's swing, a golfer can train themselves to properly swing the putter.

In U.S. Pat. No. 5,551,695, to Wolk, entitled Apparatus For Training A Golfer To Properly Putt A Golf Ball, yet another putter design is shown that uses rods. In the Wolk design, two parallel rods extend from the front of the putter's face. The rods provide both a visual indicator and a tactile indicator for a golfer. If a golfer swings straight, the rods travel straight and the golf ball strikes the putter's face without touching the rods. If a golf swing is not straight, the rods will not travel straight and the rods will strike the golf ball.

Although the use of rods is very effective in providing a visual indicator for putting straight, the use of such rods is not allowed under current USPGA rules. Thus, such putters are useful for practicing putting, but they cannot be used during an official round of golf. Consequently, a golfer using such a practice putter must have a practice putter and a different game putter. Good golfers strive for consistency. To achieve consistency in putting, most serious golfers practice putting with the same putter they use during regulation play. In this manner, golfers become accustomed to their putter and can use their putter in a consistent manner. This need for consistency has made many specialty training putters unpopular, even though many golfers could benefit from the use of such practice putters.

A need therefore exists for a golf putter that can be selectively converted between a practice putter and a regulation putter without varying the characteristics of the putter. In this manner, golfers can use the same putter both in training and during regulation play, thereby improving consistency. This need is met by the present invention as it is described and claimed below.

SUMMARY OF THE INVENTION

The present invention is a putter assembly and the method of converting a putter assembly between a practice configuration and a regulation play configuration. The putter assembly has a shaft. A handle is attached to one end of the shaft. A putter head is attached to the opposite end of the shaft. The putter head has a striking surface for striking a golf ball. A connection receptacle is disposed on the striking surface of the putter head. The connection receptacle is disposed either near the toe or heel of the putter head.

A training rod is provided that has a predetermined weight. A plug is also provided that has a weight generally equal to that of the rod. Either the rod or the plug can be attached to the connection receptacle in the putter head. When the rod is attached, the putter is configured for use in training, wherein the rod provides a reference guide during putting. When the rod is removed and the plug is set in place, the putter is ready for regulation play. Regardless of whether the rod or plug is attached to the putter head, the weight of the putter head remains consistent. Thus, a golfer can have consistency in the putter regardless of how it is configured.

BRIEF DESCRIPTION OF THE DRAWINGS

For a better understanding of the present invention, reference is made to the following description of exemplary embodiments thereof, considered in conjunction with the accompanying drawings, in which.

DETAILED DESCRIPTION OF THE DRAWINGS

In the field of golf putters, there are many different designs and styles. The illustrated embodiment of the present invention golf putter shows a golf putter of only one traditional style. It will be understood that the embodiment of the putter illustrated is merely exemplary and that the features of the present invention putter can be adapted for use on most any known putter design.

Figure 1:
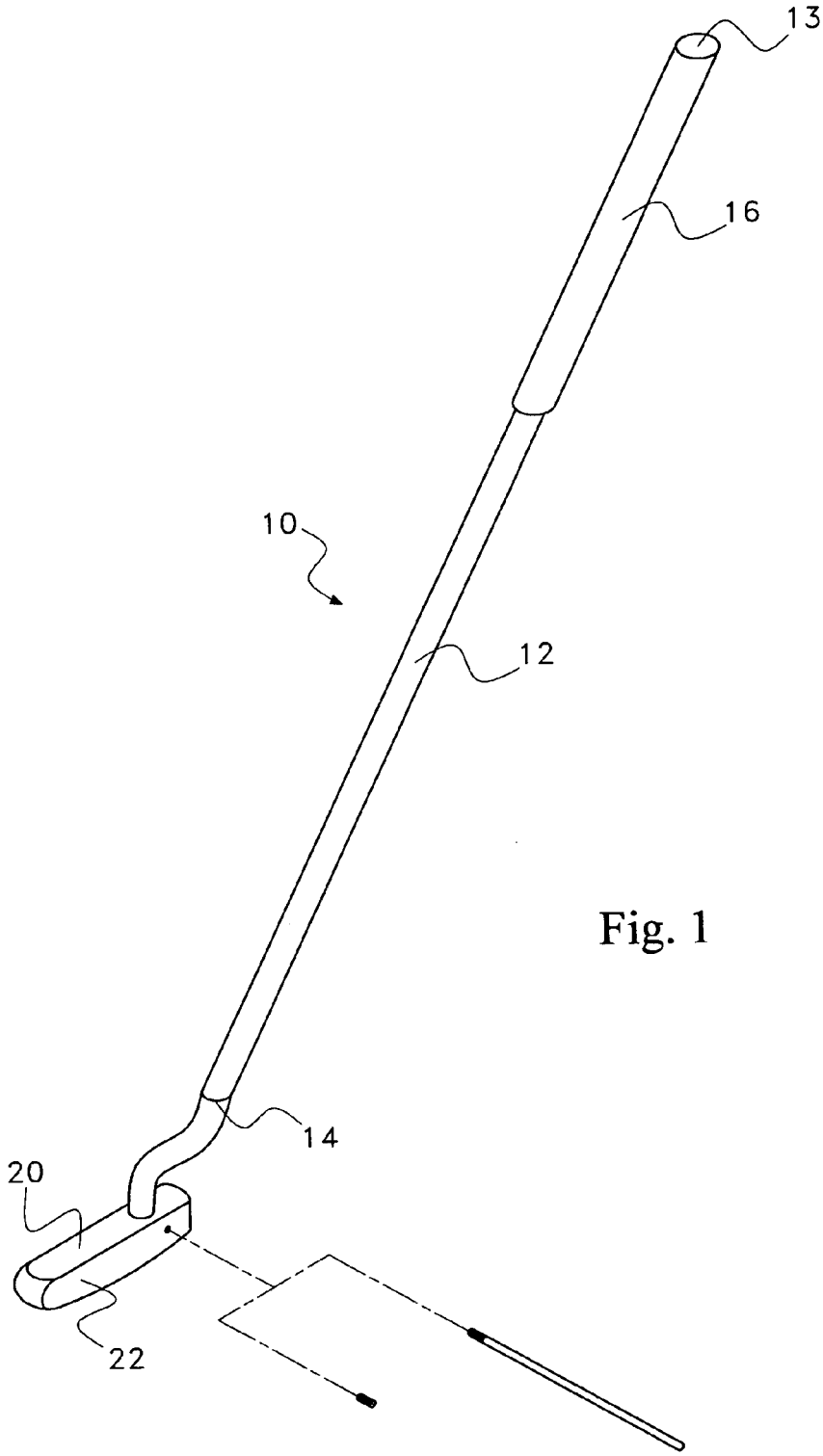
FIG. 1 is a perspective view of an exemplary embodiment of a golf putter.

Referring to FIG. 1, there is shown a putter 10. The putter 10 has a shaft 12 with a top end 13 and a bottom end 14. The top end 13 of the shaft 12 terminates with a grip handle 16. A putter head 20 is disposed at the bottom end 14 of the grip handle 16. The putter head 20 has a generally flat striking surface 22 that is used to strike a golf ball when putting.

Figure 2:
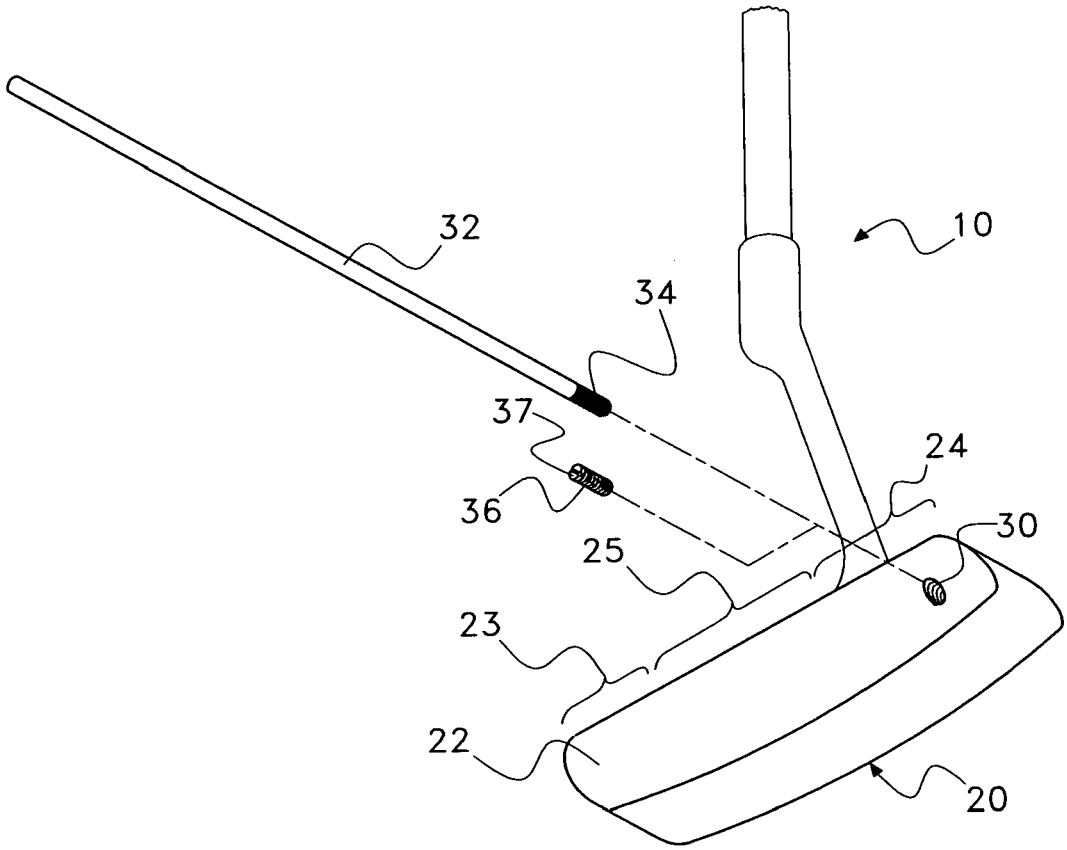
FIG. 2 is a perspective view of a putter head shown in conjunction with a training rod and weight plug.

Referring to FIG. 2, it can be seen that the striking surface 22 of the putter head 20 has a toe section 23, a heel section 24 and a central section 25 disposed in between the toe section 23 and the heel section 24. Ideally, a golfer wants to strike a golf ball with the center section 25 of the striking surface 22. It is also desired that the plane of the striking surface 22 be perfectly perpendicular to the desired line of travel for the golf ball.

A connection receptacle is shown on the striking surface 22 of the putter head 20. In the shown embodiment, the connection receptacle is a threaded bore 30 that is disposed in the heel section 24 of the striking surface 22. However, it should be understood that in an alternate embodiment, the connection receptacle can be located near the toe section 23 of the striking surface 22, as will be later explained.

Two elements are provided that can be selectively engaged with the threaded bore 30. The first element is a training rod 32. The training rod 32 is a rod between two inches and six inches in length. The training rod 32 is preferably tubular, so as to be as lightweight as possible. Although the training rod 32 can be a metal, such as aluminum, the training rod 32 can also be a synthetic material, such as plastic or a carbon composite, to make the training rod 32 more resistant to bending.

The training rod 32 has a treaded end 34 that is externally threaded with a pitch and diameter that matches the threading within the threaded bore 30. Thus, the threaded end 34 of the training rod 32 can be selectively added to the threaded bore 30 by screwing the training rod 32 into the threaded bore 30. When the training rod 32 is attached to the threaded bore 30, the training rod 32 protrudes in front of the striking surface 22 of the putter head 20 at a perpendicular to the striking surface 22.

A weighted plug 36 is also provided. The weighted plug 36 has generally the same weight as the training rod 32. Thus, the weighted plug 36 is preferably made from a dense material, such as steel or tungsten. The weighted plug 36 has a threaded exterior. The diameter and the pitch of the threads on the weighted plug 36 match the threads within the threaded bore 30. Consequently, the weighted plug 36 can be selectively screwed into the threaded bore 30. To facilitate the turning of the weighted plug 36, the tip 37 of the weighted plug 36 is slotted to receive the head of a screwdriver.

Since both the training rod 32 and the weighted plug 36 are the same weight, it will be understood that regardless of whether the weighted plug 36 or the training rod 32 is attached to the putter head 20, the weight of the putter head 20 remains constant. Thus, the swing characteristics associated with the putter head 20 remain relatively constant regardless of whether the training rod 32 or the weighted plug 36 is attached to the putter head 20.

When the weighted plug 36 is screwed into the threaded bore 30, the tip 37 of the weighted plug 36 lay flush in the striking surface 22 of the putter head 20. Thus, the putter head 20 conforms to all USPGA rules and can be used in regulation play.

When the weighted plug 36 is removed and the training rod 32 is added to the putter head 20, the putter 10 becomes a non-regulation training putter that can be used for practice. However, the weight, feel and swing characteristics of the putter 10 remain the same.

Figure 3:
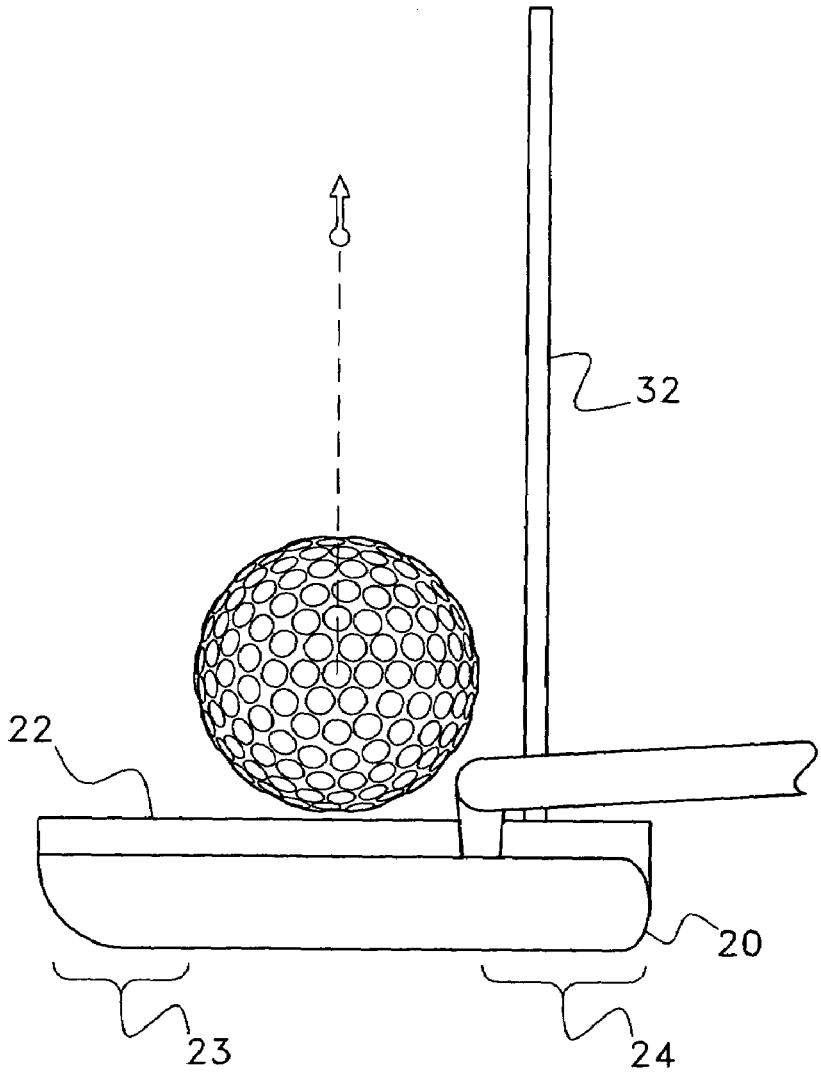
FIG. 3. is a top view of a putter head connected to a straight training rod.

Referring to FIG. 3, it can be seen that when the training rod 32 is attached to the putter head 20, the training rod 32 extends forward from the striking surface 22 of the putting head 20. The training rod 32 is supported a predetermined height above the ground. That height corresponds to half the height of a regulation golf ball. Consequently, when the training rod 32 is in place, the training rod 32 will contact the center of a golf ball should the training rod 32 come into contact with the golf ball.

The training rod 32 extends from the striking surface 22 of the putter head 20 in the heel section 24 of the putter head 20. The training rod 32 is positioned so that the training rod 32 will be between ¼ inch and ½ inch from the side of a golf ball when the golf ball strikes the exact center of the striking surface 22. It will therefore be understood that the training rod 32 will only contact the golf ball, if a golfer's swing causes the golf ball to travel toward the heel section 24 of the putter head 20. Thus, the training rod 32 provides a tactile guide that helps a golfer putt straight.

The training rod 32 also extends in the direction of travel that is perfectly perpendicular to the striking surface 22 of the putter head 20. If a golfer has a perfectly straight putting swing, the training rod 32 will travel in a straight line throughout the swing. As a result, the training rod 32 provides a visual guide that helps a golfer develop a straight putting swing.

As has been earlier mentioned, in an alternate embodiment, the training rod 32 can be attached to the putter head 20 in the toe section 23 of the putter head 20. In such an alternate embodiment, it will be understood that the training rod 32 will only contact the golf ball if a golfer's swing causes the golf ball to travel toward the toe section 23 of the putter head 20.

With most golfers, the error that occurs in their putting swing is that the golf ball travels toward the heel section 24 of the putter head 20 during the swing. It is for this reason that the shown embodiment has the training rod 32 in the heel section 24 of the putter head 20. However, if a golfer has the opposite problem, a golfer can use the embodiment of the present invention putter 10 where the training rod 32 extends from the toe section 23 of the putter head 20.

In either embodiment, it is preferred that only one training rod 32 extends from the striking surface 22 of the putter head 20. If two training rods were used, a golfer would have to approach the golf ball in an unusual manner and lower the golf club over the golf ball so that the training rods do not touch the golf ball. This would cause the approach to the golf ball during training to be different from the approach of the golf ball during regulation play. However, by using only a single training rod 32, a golfer can move the putter 10 laterally next to the golf ball and therefore approach a golf ball in the same manner they would if the training rod 32 were not present. This creates consistency between training to putt and actually putting during a game.

Due to the physiology of the human body, it is difficult to produce a perfectly straight putting swing. Rather, what is more comfortable to many golfers, is if the putting swing contains a slight arc.

Figure 4:
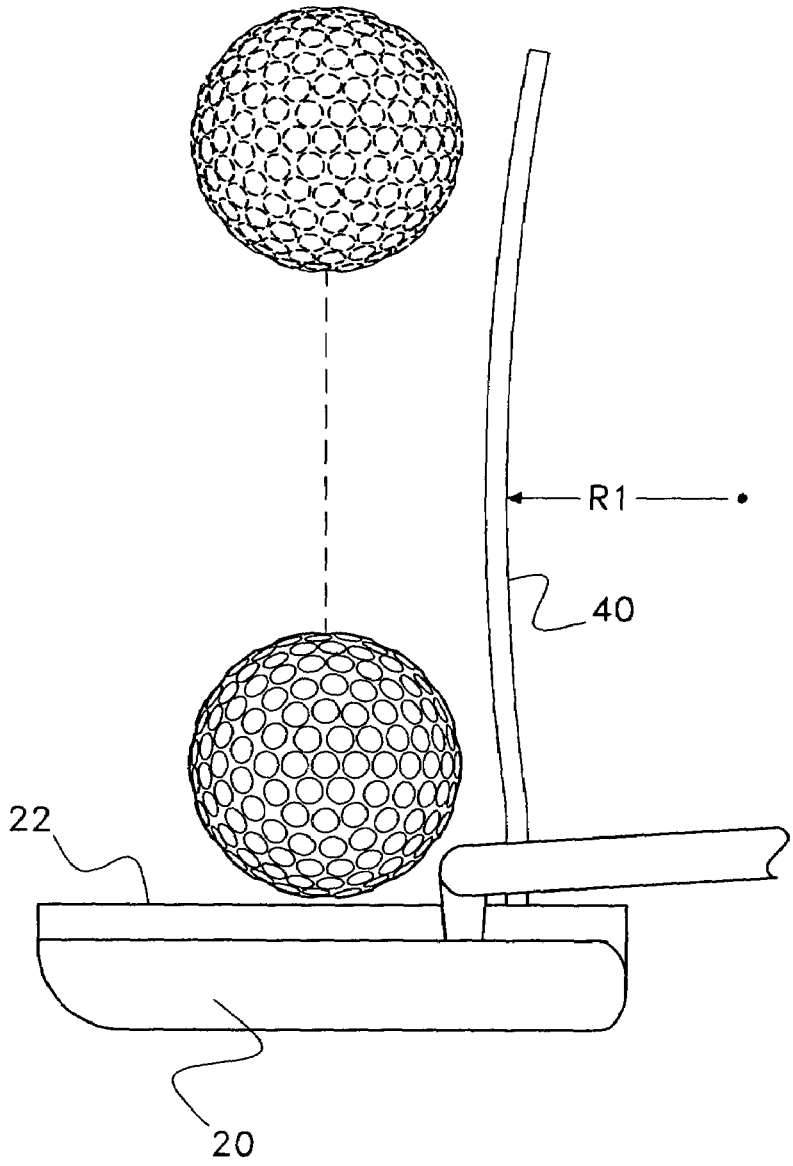
FIG. 4 is a top view of a putter head connected to a curved training rod.

Referring to FIG. 4, an alternate embodiment of the present invention is shown that uses a training rod 40 that is slightly curved. In the shown embodiment, the training rod 40 has a radius of curvature R1 that is between two feet and six feet. Consequently, the training rod 40 extends from the striking surface 22 of the putter head 20 and travels forward along an arcuate path.

When using a curved training rod 40, the golfer tries to keep the golf ball a constant distance from the training rod 40 throughout the putting swing. If a golfer does keep the training rod 40 a constant distance from the golf ball during the swing, the golf ball will strike flush against the center of the striking surface 22 and the golf ball will travel straight away from the putter head 20. As such, the curved training rod 40 also provides a tactile and visual guide to golfers that have a slight curve in their putting swing.

The present invention putter enables a golfer to attach a training rod to the striking face of the putter when the golfer is practicing golf. The training rod provides both a tactile and visual guide that helps a golfer create and perfect a straight putting swing. The use of a single training rod also enables a golfer to approach a golf ball and position the putter adjacent the golf ball in the traditional manner. Thus, the approach to the golf ball during practice can be kept consistent with the approach to the golf ball during regulation play.

When the training rod is in place, the putter head and the training rod have a predetermined combined weight. A weighted plug is provided that matches the weight of the training rod. In this manner, when the training rod is removed, the weighted plug can be put in its place and the weight of the putter head remains constant. When the weighted plug is set in place, the putter becomes a regulation putter. The putter can therefore be used in practice or regulation play and a golfer finds great consistency in the putter regardless of whether it is configured for practice or configured for regulation play.

It will be understood that the embodiments of the present invention putter that are described and illustrated are merely exemplary and that a person skilled in the art can make many variations to those embodiments. For example, the shape of the putter head can be varied to match most any known design. The method of attaching the training rod to the putter head can be varied from the threaded bore configuration shown. Alternate connection receptacles, such as a smooth bore with lateral setscrew, can be used in place of the threaded bore configuration shown. All such variations, modifications and alternate embodiments are intended to be covered by the scope of the present invention as defined by the claims.

What is claimed is:

1. A golf putter assembly, comprising:

a shaft having a first end and a second end;

a handle disposed at said first end of said shaft;

a putter head disposed at said second end of said shaft, said putter head having a striking surface for striking a golf ball;

a connection receptacle disposed in said striking surface of said putter head;

a rod having a predetermined weight;

a plug having a weight generally equal to said rod;

wherein said rod and said plug can alternately be received by said connection receptacle, and wherein said rod extends from said striking surface at a perpendicular when said rod is received within said connection receptacle.

2. The assembly according to claim 1, wherein said rod is straight.

3. The assembly according to claim 1, wherein said rod is curved.

4. The assembly according to claim 1, wherein said rod has a length of between two inches and six inches.

5. The assembly according to claim 1, wherein said striking surface of said putter head has a toe section, a heel section and a central section disposed between said toe section and said heel section, wherein said connection receptacle is disposed in said heel section.

6. The assembly according to claim 1, wherein said connection receptacle is a threaded bore and both said rod and said plug have threaded exterior surfaces that can be received by said threaded bore with a screw interconnection.

7. The assembly according to claim 1, wherein said plug does not protrude beyond said striking surface when said plug is received within said connection receptacle.

8. A method of altering a configuration of a golf putter for use in training and for use in regulation play, said method comprising the steps of:

providing a putter having a striking face for striking a golf ball;

providing a straight rod of a predetermined weight;

providing a weight that weighs the same as said rod;

attaching said rod to said putter to configure said putter for use in training; and replacing said rod with said weight on said putter to configure said putter for use in regulation play.

9. The method according to claim 8, wherein said step of providing a rod includes providing a curved rod.

10. The method according to claim 8, wherein a connection receptacle is disposed in said striking surface of said putter.

11. The method according to claim 10, wherein said step of attaching said rod to said putter includes joining said rod to said connection receptacle.

12. The method according to claim 11, wherein said step of replacing said rod with said weight includes removing said rod from said connection receptacle and placing said weight in said connection receptacle.

13. A putter head assembly, comprising:

a striking surface for striking a golf ball, said striking surface having a toe region, a heel region and a center region disposed between said toe region and said heel region;

a single threaded bore disposed in said striking surface;

a single rod having a threaded end, wherein said threaded end of said rod can be selectively received within the threaded bore, thereby causing said rod to protrude forward from said striking surface; and a weighted plug that has a weight generally equal to that of said rod, wherein said weighted plug is threaded and can be selectively received within said threaded bore in place of said rod.

14. The assembly according to claim 13, wherein said rod is straight.

15. The assembly according to claim 13, wherein said rod is curved.

16. The assembly according to claim 13, wherein said threaded bore is disposed in said heel section of said striking surface.

17. The assembly according to claim 13, wherein said threaded bore is disposed in said toe section of said striking surface.

* * * * *